United States Patent [19]

Nagatomo et al.

[11] 4,272,011

[45] Jun. 9, 1981

[54] CENTRIFUGAL COUNTERFLOW TYPE CONTACTOR

[75] Inventors: Katsuaki Nagatomo; Shigenobu Hisatomi; Kiyoshi Fujiwara; Hiromasa Fukumori; Shoji Yoshinaga, all of Kudamatsu; Kyozo Yoshioka, Hikari, all of Japan

[73] Assignee: Hitachi, Ltd., Tokyo, Japan

[21] Appl. No.: 932,657

[22] Filed: Aug. 10, 1978

[30] Foreign Application Priority Data

Aug. 10, 1977 [JP] Japan ..... 52-95076

[51] Int. Cl.[3] ..... B04B 5/06

[52] U.S. Cl. ..... 233/15

[58] Field of Search ..... 233/15, 12, 27, 28, 233/32, 33, 44

[56] References Cited

U.S. PATENT DOCUMENTS

| | | | |
|---|---|---|---|
| 1,573,498 | 2/1926 | Nicol | 233/27 |
| 2,670,132 | 2/1954 | Podbielniak | 233/15 |
| 2,758,784 | 8/1956 | Podbielniak et al. | 233/15 |
| 3,027,390 | 3/1962 | Thurman | 233/15 X |
| 3,053,440 | 9/1962 | Doyle et al. | 233/15 |
| 3,116,246 | 12/1963 | Podbielniak | 233/15 |
| 3,217,980 | 11/1965 | Podbielniak et al. | 233/15 |
| 3,327,939 | 6/1967 | Doyle et al. | 233/15 |
| 3,344,983 | 10/1967 | Podbielniak | 233/15 |

FOREIGN PATENT DOCUMENTS

| | | | |
|---|---|---|---|
| 48-747 | 1/1973 | Japan | 233/15 |

*Primary Examiner*—George H. Krizmanich
*Attorney, Agent, or Firm*—Craig & Antonelli

[57] ABSTRACT

A centrifugal counterflow type contactor wherein the interior space of a drum carried by a rotating shaft has a predetermined axial width or the interior space of the drum is divided by at least one baffle plate mounted on the rotating shaft into at least two chambers each having a predetermined width; and a light liquid is introduced into said interior space or each chamber at positions adjacent to the radially outward end thereof while a heavy liquid is introduced into said interior space or each chamber at positions adjacent to the radially inward end thereof so that rapid rotation of the drum causes the radial counterflow contact between the light and heavy liquids. The extraction efficiency is equal to or higher than that of a corresponding prior art centrifugal contactor, and the solids in the liquids may be prevented from being accumulated in the counterflow region.

16 Claims, 7 Drawing Figures

CENTRIFUGAL COUNTERFLOW TYPE CONTACTOR

FIELD OF THE INVENTION

The present invention relates to an apparatus for separating a heavy liquid and a light liquid, which are mutually insoluble, by contacting the former with the latter, and more particularly to a centrifugal counterflow type contactor of the type wherein a light liquid is led internally to the periphery of a drum and a heavy liquid to the axis thereof and rapid rotation of the drum causes the radial counterflow contact of the light and heavy liquids.

DESCRIPTION OF THE PRIOR ART

In general, the prior art centrifugal counterflow type contactors contain a plurality of concentric perforate cylinders in a drum carried by a rotating shaft so that the radial counterflow of a light liquid and a heavy liquid may be caused through the cylinders. Upon rotation of the drum the centrifugal forces act upon the cylinders at right angles so that the solids with relatively high specific gravity in the light and heavy liquids are forced to accumulate on the interior surfaces of the perforate cylinders. As a result, the static and dynamic balances of the drum are lost so that vibration results. Moreover because of the clogging of the perforate cylinders the performance or efficiency is adversely affected. In addition, the prior art centrifugal contactors have a common problem that cleaning of the drum from the exterior is difficult because it contains a plurality of concentric perforate cylinders.

SUMMARY OF THE INVENTION

A first object of the present invention is therefore to provide a centrifugal counterflow type contactor which may eliminate concentric perforate cylinders but may ensure the extraction efficiency substantially equal to or even higher than that of a prior art equivalent centrifugal contactor.

A second object of the present invention is to provide a centrifugal counterflow type contactor which may eliminate the accumulation of solids in the liquids in the counterflow region.

A third object of the present invention is to provide a centrifugal counterflow type contactor wherein when the capacity is increased with the resultant increase in axial dimensions, at least one baffle plate is mounted on a rotating shaft so as to divide the interior space of a drum into at least two chambers, whereby the desired extraction efficiency may be maintained.

A fourth object of the present invention is to provide a centrifugal counterflow type contactor wherein the solids in a light liquid and/or a heavy liquid may be accumulated on the drum periphery or the radially outward portion of the space in the drum, whereby the cleaning of the accumulated solids from the exterior may be facilitated.

To the above and other objects, briefly stated, the present invention provides a centrifugal counterflow type contactor comprising a rotating shaft; a drum carried by said rotating shaft for rotation in unison therewith, said drum defining an interior annular space with a predetermined axial width; a light-liquid-in line means and a heavy-liquid-in line means both formed in said rotating shaft, a light liquid introducing means for introducing through said light-liquid-in line means a light liquid into said annular space in said drum at positions adjacent to the radially outward end or the outer periphery of said annular space; a heavy liquid introducing means for introducing through said heavy-liquid-in line means a heavy liquid into said annular space in said drum at positions adjacent to the radially inward end or the inner periphery of said annular space; a light-liquid-out line means and a heavy-liquid-out line means both formed in said rotating shaft; a light-liquid-lead-out line means for leading out said light liquid through said light-liquid-out line means from said annular space in said drum at positions in the vicinity of said radially inward end or the inner periphery of said annular space; and a heavy liquid-lead-out line means for leading out said heavy liquid through said heavy-liquid-out line means from said annular space in said drum at positions in the vicinity of said radially outward end or the outer periphery of said annular space, whereby the radial counterflow contact may be caused between said light liquid introduced into said annular space adjacent to said radially outward end thereof and said heavy liquid introduced into said annular space adjacent to said radially inward end thereof.

Opposed to the prior art centrifugal contactors, the present invention eliminates a plurality of cencentric perforate cylinders so that even when solids are contained in a light liquid and/or a heavy liquid, the vibration of the drum and the clogging may be avoided and the accumulation of the solids in the counterflow region may be eliminated, whereby a high extraction efficiency may be ensured.

According to one aspect of the present invention, at least one baffle plate is mounted on a rotating shaft in such a way that the interior space of a drum may be divided into at least two chambers which are spaced apart axially from each other by a suitable distance. Therefore even in case of a large capacity centrifugal counterflow type contactor with increased axial dimensions, the extraction efficiency may be maintained equal to or even higher than that of a corresponding prior art centrifugal contactor.

According to another aspect of the present invention, the solids contained in a light liquid and/or a heavy liquid may be accumulated in the vicinity of the outer periphery or the radially outward end of the space in the drum so that the removal of the accumulated solids from the exterior of the drum may be much facilitated.

DESCRIPTION OF THE PREFERRED EMBODIMENT

Figure 1:
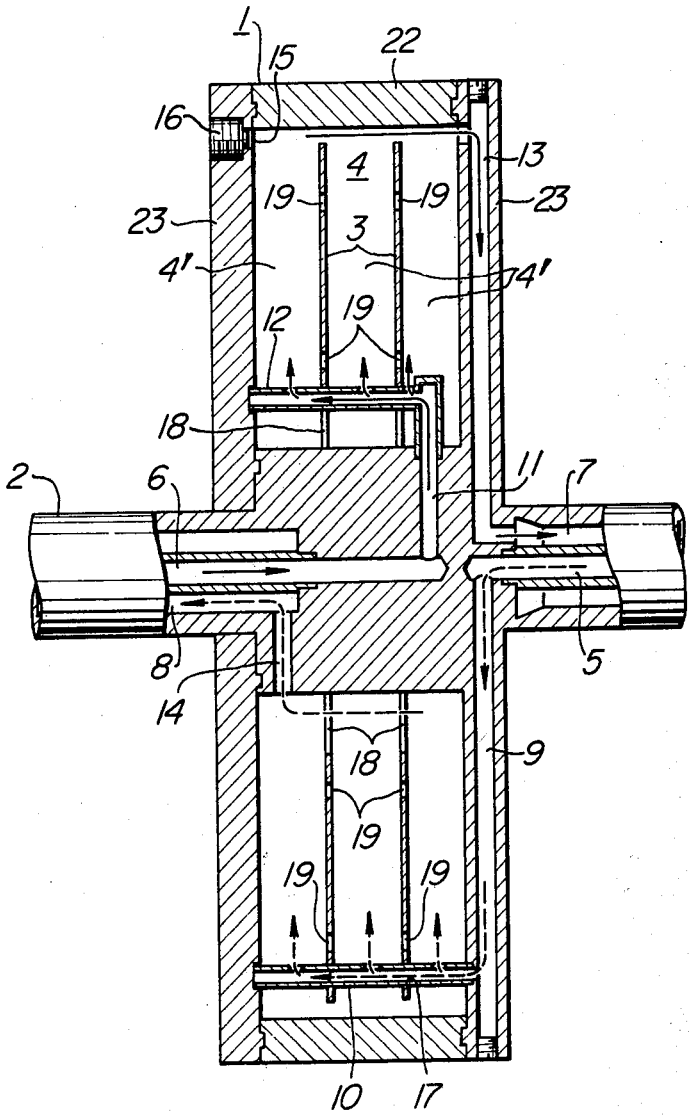
FIG. 1 is a vertical sectional view of a preferred embodiment of a centrifugal counterflow type contactor in accordance with the present invention.

Referring to the accompanying drawings and particularly to FIG. 1, a drum 1 which is carried by a rotating shaft 2 for rotation in unison therewith has a peripheral wall 22 and side walls 23 which are horizontally spaced apart from each other and are attached to the peripheral wall 22 so as to define an annular space 4 around the rotating shaft 2. The space 4 is further divided into three chambers 4' by means of two baffle plates 3 which are mounted on the rotating shaft 2, horizontally spaced apart from each other and the side walls 23 by a suitable distance and are extended radially of the rotating shaft 2. Instead of two baffle plates 3, any desired number of baffle plates 3 may be mounted on the rotating shaft 2 so that each of the chambers 4' may have a suitable width in the axial direction. Moreover, when the distance between the side walls 23 is such that the space 4 may have a suitable width in the axial direction, no baffle plate is needed.

A light liquid is introduced into the chambers 4' through a light-liquid-in line 5 bored or otherwise formed through the rotating shaft 2 coaxially thereof, a light liquid passageway 9 formed through the side wall 23 and a discharge pipe 10 disposed adjacent to the peripheral wall 22. A heavy liquid is introduced into the chambers 4' through a heavy-liquid-in line 6 bored through the rotating shaft 2 coaxially thereof, a heavy liquid passageway 11 extended through the rotating shaft 2 radially thereof and a heavy liquid discharge pipe 12 extended axially adjacent to the rotating shaft 2.

The light liquid is discharged out of the chambers 4' through a radially extended light liquid discharge passageway 14 in the rotating shaft 2 and a light-liquid-out line 8 bored in the rotating shaft 2 coaxially and externally of the heavy-liquid-in line 6. The heavy liquid is externally discharged from the chambers 4' through a heavy-liquid discharged passageway 13 formed in the side wall 23 and a heavy-liquid-out line 7 bored in the rotating shaft 2 coaxially and externally of the light-liquid-in line 5.

A cleaning hole 15 which is formed through the side wall 23 adjacent to the peripheral wall 22 is normally closed with a plug 16. The light liquid discharged pipe 10 is fitted into holes 17 (See FIGS. 5 and 6) formed through the baffle plates 3. The baffle plates 3 are also formed with light liquid discharge openings 18 (See also FIGS. 5 and 6) around the center so that the light liquid may flow through these openings 18 into the radial light liquid discharge passageway 14 in the rotating shaft 2. The heavy liquid discharge pipe 12 is fitted into one of the openings 18. In addition, the baffle plates 3 are formed with a plurality of pressure equalizing holes 19 so that the pressures in the chambers 4' may be equalized or brought to equilibrium. Moreover the baffle plates 3 are each formed with a plurality of coaxial grooves 20 (See FIG. 6) which offer resistance to the radial flows of the liquids.

Next the mode of operation will be described. The light liquid is led internally through the light-liquid-in line 5, the radial light liquid passageway 9 and the light liquid discharge pipe 10 into the chambers 4' at positions closer to the peripheral wall 22 of the drum 1. The heavy liquid is introduced internally through the heavy-liquid-in line 6, the radial heavy liquid passageway 11 and the heavy liquid discharge pipe 12 into the chambers 4' at positions closer to the rotating shaft 2. Due to the centrifugal force produced by high speed rotation of the drum 1, the counterflows of the light and heavy liquids and the contact of the former with the latter results. Thereafter the heavy liquid flows into the radial heavy liquid discharge passageway 13 through its inlet adjacent to the peripheral wall 22 of the drum 1 and is led out through the heavy-liquid-out line 7. The light liquid is led out through the openings 18 in the baffle plates 3 adjacent to the rotating shaft 2, the radial light liquid discharge passageway 14 and the light-liquid-out line 8 in the rotating shaft 2.

The solids with relatively high specific gravity contained in the liquids are accumulated due to the centrifugal force at places adjacent to the interior surface of the peripheral wall 22. The accumulated solids may be easily removed by removing the plug 16 and flushing a cleaning liquid or the like through the cleaning hole 15.

Figure 2:
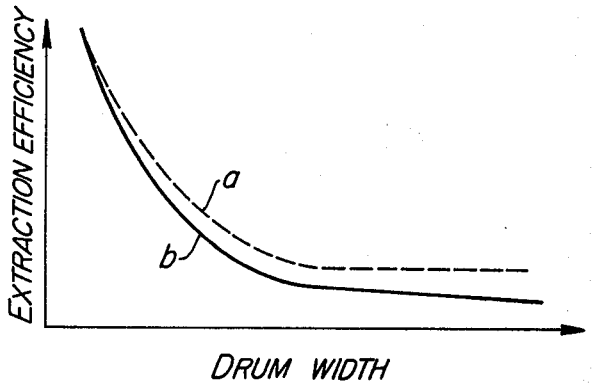
FIG. 2 shows the drum width vs. extraction efficiency characteristic curve of the centrifugal contactor in accordance with the present invention in comparison with the characteristic curve of a corresponding prior art centrifugal contactor.

Next the extraction performance of the centrifugal counterflow type contactor in accordance with the present invention will be described with reference to FIGS. 2, 3 and 4. FIG. 2 shows the relationship between the width (in the axial direction) of the drum and the extraction efficiency. The broken line curve a is of a prior art contactor containing a plurality of concentric perforate cylinders in a rotary drum while the solid line curve b, of the contactor of the present invention, provided that no baffle plate is provided in the drum. It can be seen that with the prior art contactor, the greater the width of the drum, the less the extraction efficiency becomes and that the extraction efficiency curve a becomes flat beyond a certain width of the drum. Same is true for the centrifugal contactor in accordance with the present invention except that the extraction efficiency is less with the same width. However, when the drum width is very small, there is almost no difference between the characteristic curves a and b. As shown in FIG. 2, when the drum width is small the difference between the extraction efficiencies shown by curves a and b is of the order of 5 to 10%, and this difference is smaller than that between the extraction efficiencies shown by curves a and b when the drum width is increased. In general, the drum width has been so selected in practice that the extraction efficiency may be constant. That is, even when concentric perforate cylinders are not used, the counterflow contact may be effected without the reduction in extraction efficiency when the interior space of the drum is axially divided by at least one annular baffle plate.

The features of the present invention reside in the facts that the clogging problem encountered in the prior art centrifugal contacting apparatus may be eliminated by the removal of concentric perforate cylinders and that the extraction efficiency may be maintained equal to or higher than that of the prior art contactor by dividing the interior space of the drum as will be described based on the results of the theoretical analysis and experiments.

First referring to FIG. 3, the flow of liquids in the field of the centrifugal force due to the rotation of a drum at a high speed when no baffle plate is provided will be described. The inventors made extensive studies and experiments and have found out that the flow velocity distribution in the drum 1 is such that radial velocity component 21 varies in the axial direction of the drum 1 (hereinafter referred to as "drift"), and that this adversely affects the extraction efficiency. The present invention was made based upon on this observed fact. That is, in the rotating drum 1, due to the centrifugal force, the heavy liquid is distributed in the radially outward portion of the space 4 while the light liquid is distributed in the radially inward portion, whereby the heavy and light liquids form continuous layers, respectively. The heavy and light liquids in the form of droplets pass through the light and heavy liquid layers, respectively. Let's consider the flow in the continuous layer of the heavy liquid. (The following explanation may be also applicable to the flow in the continuous layer of the light liquid from the theoretical viewpoint.) In addition to the radial velocity component 21, the heavy liquid has the circumferential velocity component $v_o$ due to the rotation of the drum 1. When the heavy liquid flows from the center of the drum 1 toward the peripheral wall 22 thereof, its circumferential velocity component $v_o$ tends to maintain its angular momentum so that the circumferential velocity component $v_o$ substantially remains unchanged, i.e., when the heavy liquid flows in a radial direction, the value of its circumferential velocity component $v_o$ is almost constant at any position. The peripheral velocity $u_o$ of the drum 1 is in proportion to the radius of the drum 1 so that $v_o < u_o$. On the other hand, in the vicinity of the side wall 23, $v_o \approx u_o$ because of the presence of the side wall 23. Thus, the circumferential flow velocity distribution is such that the circumferential velocity component $v_o$ is high in the vicinity of the side walls 23 of the drum and is low between them. Since the pressure of the liquid is in proportion to $v_o^2$, the pressure difference occurs in the axial direction of the drum 1 so that the radial velocity component 21 is higher in the vicinity of the side walls 23 and is lower between them, whereby the "drift" results. This "drift" phenomenon is physical and occurs regardless of the presence or absence of concentric perforate cylinders in the drum 1. When the drum width is small, the circumferential velocity component $v_o$ approaches the peripheral velocity $u_o$ of the drum 1 so that the "drift" phenomenon is less observed. On the other hand, when the width (in the axial direction) of the drum 1 is increased, the circumferential velocity component $v_o$ varies in the axial direction of the drum 1 (the component $v_o$ becomes lower as it goes away from the side walls 23) so that the significant "drift" phenomenon occurs. Therefore in order to improve the extraction efficiency, the axial width of the drum 1 must be less than a certain width.

Figure 4:
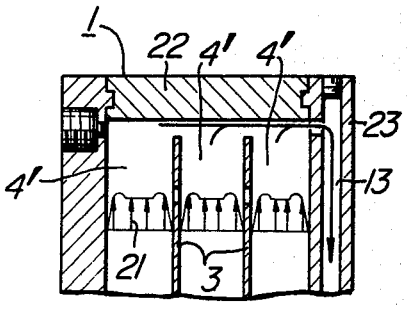

FIG. 4 shows that the disk-shaped baffle plates 3 are mounted on the rotating shaft 2 as described above so that the space 4 is divided into three chambers 4' with a suitable axial width and consequently the "drift" phenomenon may be suppressed and the extraction efficiency may be improved.

Thus, even with a centrifugal counterflow type contactor having no concentric perforate cylinder, the extraction efficiency may be maintained equal to or may be improved over that of a centrifugal contactor with concentric perforate cylinders when the axial width of the drum 1 is less than a certain width.

Figure 3:
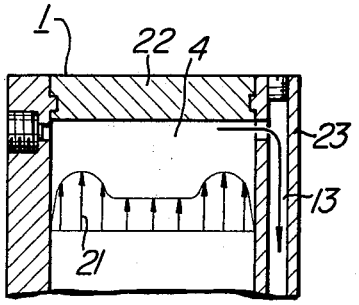
FIGS. 3 and 4 are fragmentary sectional views, respectively, of the drum used for the explanation of the "drift" phenomenon.

Furthermore, according to the experiments the inventors found out that the annular grooves formed in the interior surfaces of the side walls 23 of the drum 1 offer resistance to the radial flows of the liquids so that the "drift" phenomenon as shown in FIG. 3 may be considerably suppressed. According to the experiments, the extraction efficiency is improved by about 20%.

Figure 6:
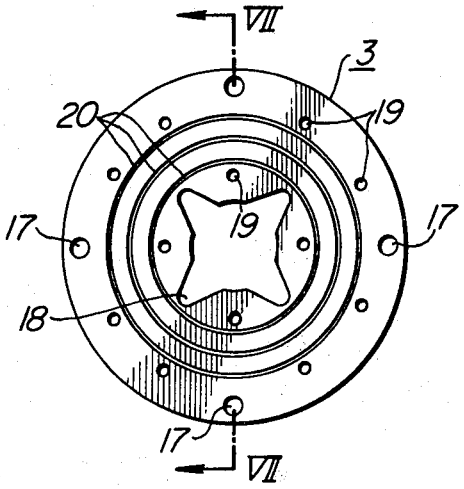
FIG. 6 shows a front view of another example of a baffle plate used in the present invention.
Figure 7:
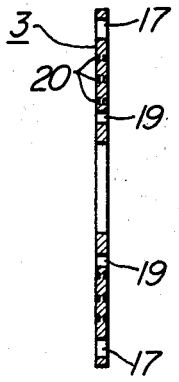
FIG. 7 is a sectional view thereof taken along the line VII—VII of FIG. 6.

FIGS. 6 and 7 shows the baffle plate 3 both the surfaces of which are formed with the concentric annular grooves 20 for the same purpose as described above.

Figure 5:
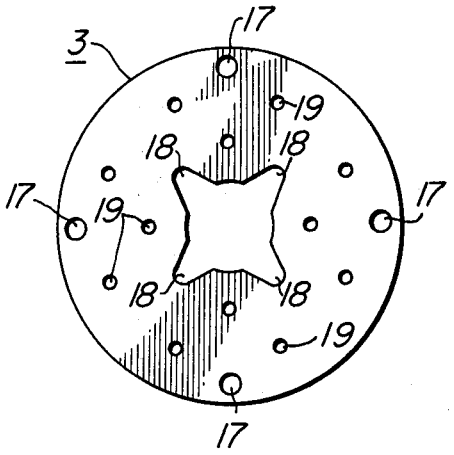
FIG. 5 shows a front view of one example of a baffle plate used in the present invention.

When the baffle plates 3 are built in the drum 1 and when the heavy and/or light liquids contain solids, there results in the difference in density in the drum 1 and consequently upon rotation of the drum 1 there occurs the difference in pressure within the drum 1 due to the centrifugal force. However, in accordance with the present invention, in order to overcome the problems caused by the pressure difference in the drum 1, as shown in FIGS. 5, 6 and 7 the baffle plates 3 are provided with a suitable number of pressure equalizing holes 19 so that the pressures in the chambers 4 may be substantially equalized. Thus, the smooth operation of the centrifugal contactor may be ensured.

It is to be understood that the present invention is not limited to the baffle plates 3 of the types shown in FIGS. 5, 6 and 7 and that they may be in any form effective to suppress the "drift" phenomenon described above.

What we claim is:

1. A centrifugal counterflow type contactor comprising (a) a rotating shaft, (b) a drum carried by said rotating shaft for rotation in unison therewith, said drum defining an interior annular space with an axial width, said drum adapted to have a light liquid and a heavy liquid flow therethrough in a radial direction, whereby the radial flow velocity may vary in the axial direction of said drums, the axial width being smaller than a preselected axial width so that the variation in radial flow velocity is suppressed, (c) a light-liquid-in line means and a heavy-liquid-in line means both formed in said rotating shaft, (d) a light liquid introducing means for introducing through said light-liquid-in line means a light liquid into said annular space in said drum at positions adjacent to the radially outward end or the outer periphery of said annular space, (e) a heavy liquid introducing means for introducing through said heavy-liquid-in line means a heavy liquid into said annular space in said drum at positions adjacent to the radially inward end or the inner periphery of said annular space, (f) a light-liquid-out line means and a heavy-liquid-out line means both formed in said rotating shaft, (g) a light-liquid-lead-out line means for leading out said light liquid through said light-liquid-out line means from said annular space in said drum at positions in the vicinity of said radially inward end or the inner periphery of said annular space, and (h) a heavy-liquid-lead-out line means for leading out said heavy liquid through said heavy-liquid-out line means from said annular space in said drum at positions in the vicinity of said radially-outward end or the outer periphery of said annular space, whereby the radial counterflow contact may be caused between said light liquid introduced into said annular space adjacent to said radially outward end thereof and said heavy liquid introduced into said annular space adjacent to said radially inward end thereof.

2. A centrifugal counterflow type contactor as set forth in claim 1, wherein said drum has side walls which are axially spaced apart from each other and whose interior surfaces are formed with recesses and ridges.

3. A centrifugal counterflow type contactor as set forth in claim 2, wherein one of said side walls is formed with a cleaning hole adjacent to the outer periphery thereof which may be selectively opened or closed and through which a cleaning liquid or the like may be introduced into said drum.

4. A centrifugal counterflow type contactor comprising (a) a rotating shaft, (b) a drum carried by said rotating shaft for rotation in unison therewith, said drum defining within itself a space having an annular cross section, (c) at least one baffle plate mounted on said rotating shaft and axially spaced apart from each other in such a way that said annular space may be divided into a plurality of chambers each having an axial width, each of said chambers adapted to have a light liquid and a heavy liquid flow therethrough in a radial direction, whereby the radial flow velocity may vary in the axial direction in each of said chambers, the axial width of each chamber being smaller than a preselected axial width so that the variation in radial flow velocity is suppressed, (d) a light-liquid-in line means and a heavy-liquid-in line means both extended through said rotating shaft, (e) a light liquid introducing means for introducing through said light-liquid-in line means a light liquid into each of said chambers of said annular space in said drum at positions adjacent to the radially outward end or the outer periphery of each of said chambers, (f) a heavy liquid introducing means for introducing through said heavy-liquid-in line means a heavy liquid into each of said chambers of said annular space in said drum at positions adjacent to the radially inward end or the inner periphery of each of said chambers, (g) a light-liquid-out line means and a heavy-liquid-out line means both extended through said rotating shaft, (h) a light liquid leading out means for leading out through said light-liquid-out line means said light liquid in each chamber from positions in the vicinity of said radially inward end or said inner periphery thereof, and (i) a heavy liquid leading out means for leading out through said heavy-liquid-out line means said heavy liquid in each chamber from positions in the vicinity of said radially outward end or said outer periphery thereof, whereby the radial counterflow contact may be caused between said light liquid introduced into said chambers at said positions adjacent to said radially outward end thereof and said heavy liquid introduced into said chambers at said positions adjacent to said radially inward end thereof.

5. A centrifugal counterflow type contactor as set forth in claim 4, wherein said at least one baffle plate is formed with at least one hole formed therethrough so as to attain the pressure equilization among said chambers.

6. A centrifugal counterflow type contactor as set forth in claim 4 or 5 wherein said at least one baffle plate is formed with recesses and ridges on its surfaces.

7. A centrifugal counterflow type contactor as set forth in claim 4, wherein said drum has side walls which are axially spaced apart from each other and the interior surfaces of which are formed with recesses and ridges.

8. A centrifugal counterflow type contactor as set forth in claim 7, wherein one of said side walls is formed with at least one cleaning hole adjacent to the outer periphery thereof which may be selectively opened and closed and through which may be introduced a cleaning liquid or the like into said drum.

9. A centrifugal counterflow type contactor as set forth in claim 1, wherein said contactor consists essentially of components (a) through (h).

10. A centrifugal counterflow type contactor as set forth in claim 4, wherein said contactor consists essentially of components (a) through (i).

11. A centrifugal counterflow type contactor comprising (a) a rotating shaft, (b) a drum carried by said rotating shaft for rotation in unison therewith, said drum having a continuous interior annular space with an axial width, said drum adapted to have a light liquid and a heavy liquid flow therethrough in a radial direction, whereby the radial flow velocity may vary in the axial direction of said drum, the axial width being smaller than a preselected axial width so that the variation in radial flow velocity is suppressed, whereby extraction efficiency of said contactor is increased, (c) a light-liquid-in line means and a heavy-liquid-in line means both formed in said rotating shaft, (d) a light liquid introducing means for introducing through said light-liquid-in line means a light liquid into said annular space in said drum at positions adjacent to the radially outward end or the outer periphery of said annular space, (e) a heavy liquid introducing means for introducing through said heavy-liquid-in line means a heavy liquid into said annular space in said drum at positions adjacent to the radially inward end or the inner periphery of said annular space, (f) a light-liquid-out line means and a heavy-liquid-out line means both formed in said rotating shaft, (g) a light-liquid-lead-out line means for leading out said light liquid through said light-liquid-out line means from said annular space in said drum at positions in the vicinity of said radially inward end or the inner periphery of said annular space, and (h) a heavy-liquid-lead-out means for leading out said heavy liquid through said heavy-liquid-out line means from said annular space in said drum at positions in the vicinity of said radially outward end or the outer periphery of said annular space, whereby the radial counterflow contact may be caused between said light liquid introduced into said annular space adjacent to said radially outward end thereof and said heavy liquid introduced into said annular space adjacent to said radially inward end thereof.

12. A centrifugal counterflow type contactor comprising (a) a rotating shaft, (b) a drum carried by said rotating shaft for rotation in unison therewith, said drum having within itself a space having an annular cross section with an inner periphery and an outer periphery, (c) at least one baffle plate mounted on said rotating shaft and axially spaced apart from each other in such a way that said annular space may be divided into a plurality of chambers each having an axial width, each of said chambers extending continuously from a position in the vicinity of the inner periphery of said space to a position in the vicinity of the outer periphery of said space, each of said chambers adapted to have a light liquid and a heavy liquid flow therethrough in a radial direction, whereby the radial flow velocity may vary in the axial direction in each of said chambers, the axial width of each chamber being smaller than a preselected axial width so that the variation in radial flow velocity is suppressed, whereby extraction efficiency of said contactor is increased, (d) a light-liquid-in line means and a heavy-liquid-in line means both extended through said rotating shaft, (e) a light liquid introducing means for introducing through said light-liquid-in line means a light liquid into each of said chambers of said annular space in said drum at positions adjacent to the radially outward end or the outer periphery of each of said chambers, (f) a heavy liquid introducing means for introducing through said heavy-liquid-in line means a heavy liquid into each of said chambers of said annular space in said drum at positions adjacent to the radially inward end or the inner periphery of each of said chambers, (g) a light-liquid-out line meand and a heavy-liquid-out line means both extended through said rotating shaft, (h) a light liquid leading out means for leading out through said light-liquid-out line means said light liquid in each chamber from positions in the vicinity of said radially inward end or said inner periphery thereof, and (i) a heavy liquid leading out means for leading out through said heavy-liquid-out line means said heavy liquid in each chamber from positions in the vicinity of said radially outward end or said outer periphery thereof, whereby the radial counterflow contact may be caused between said light liquid introduced into said chambers at said positions adjacent to said radially outward end thereof and said heavy liquid introduced into said chambers at said positions adjacent to said radially inward end thereof.

13. A centrifugal counterflow type contactor as set forth in one of claims 1 or 11, wherein said drum has side walls whose interior surfaces are formed with recesses and ridges, whereby the variation in radial flow velocity in the axial direction is suppressed, thereby increasing the extraction efficiency of said contactor.

14. A centrifugal counterflow type contactor as set forth in one of claims 4 or 12, wherein said drum has side walls whose interior surfaces are formed with recesses and ridges, whereby the variation in radial flow velocity in the axial direction is suppressed, thereby increasing the extraction efficiency of said contactor.

15. A centrifugal counterflow type contactor as set forth in claim 14, wherein said at least one baffle plate is formed with recesses and ridges on its surfaces, whereby the variation in radial flow velocity in the axial direction is suppressed, thereby increasing the extraction efficiency of said contactor.

16. A centrifugal counterflow type contactor as set forth in one of claims 4 or 12, wherein said at least one baffle plate is formed with recesses and ridges on its surfaces, whereby the variation in radial flow velocity in the axial direction is suppressed, thereby increasing the extraction efficiency of said contactor.

* * * * *